US007172102B2

(12) United States Patent
Lewien et al.

(10) Patent No.: US 7,172,102 B2
(45) Date of Patent: Feb. 6, 2007

(54) COLLAPSIBLE CLOTHES HANGER

(76) Inventors: Kim A. Lewien, 2747 Wilson-Cambria Rd., Wilson, NY (US) 14172; John W. Lewien, 2747 Wilson-Cambria Rd., Wilson, NY (US) 14172

( * ) Notice: Subject to any disclaimer, the term of this patent is extended or adjusted under 35 U.S.C. 154(b) by 81 days.

(21) Appl. No.: 11/082,132

(22) Filed: Mar. 17, 2005

(65) Prior Publication Data

US 2006/0208010 A1 Sep. 21, 2006

(51) Int. Cl.
*A41D 27/22* (2006.01)

(52) U.S. Cl. ..... 223/89

(58) Field of Classification Search ..... 223/85–98; D6/319, 327, 328

See application file for complete search history.

(56) References Cited

U.S. PATENT DOCUMENTS

| | | | | |
|---|---|---|---|---|
| 1,955,995 | A * | 4/1934 | Wood | 223/89 |
| 2,420,116 | A | 5/1947 | Walters | |
| 2,544,170 | A * | 3/1951 | Mills | 223/89 |
| 2,605,942 | A * | 8/1952 | Comer et al. | 223/89 |
| 2,745,579 | A * | 5/1956 | Goodman | 223/94 |
| 3,645,426 | A * | 2/1972 | Glascock et al. | 223/89 |
| 5,007,562 | A | 4/1991 | Brink et al. | |
| 5,044,534 | A | 9/1991 | Hwang | |
| 5,590,823 | A * | 1/1997 | Lunde | 223/94 |
| 5,893,493 | A | 4/1999 | Noiray | |
| 6,427,882 | B1 | 8/2002 | Harvey | |
| 2002/0056735 | A1 | 5/2002 | Lam | |
| 2002/0158091 | A1 | 10/2002 | Matkovich | |
| 2003/0132258 | A1 | 7/2003 | Viazanko et al. | |
| 2003/0183666 | A1 | 10/2003 | Kameda | |
| 2004/0211797 | A1 | 10/2004 | Landis et al. | |

FOREIGN PATENT DOCUMENTS

| | | | |
|---|---|---|---|
| JP | 06181835 | A * | 7/1994 |

* cited by examiner

*Primary Examiner*—Shaun R. Hurley

(57) ABSTRACT

A collapsible garment hanger includes a central support member comprising a supporting hook, a pair of elongate upper members pivotally connected to and extending in opposite directions from the central support member and a lower member pivotally connected between the far ends of the upper members, the lower member comprising a pair of elongate pivotally connected segments which when pivoted at their connecting point displace toward the central support member to provide a stable platform for supporting a garment hanging therefrom and away from the central support member to collapse and release a garment hanging therefrom.

19 Claims, 3 Drawing Sheets

COLLAPSIBLE CLOTHES HANGER

FIELD OF THE INVENTION

The present invention, relates generally to garment hangers, and more particularly to a novel collapsible clothes hanger.

BACKGROUND OF THE INVENTION

Conventional clothes hangers typically comprise an integrally formed rigid structure having a hook means or the like for attachment to a hanger rod, a pair of downwardly angled upper members extending in opposite directions from the hook, with or without a lower transverse member extending between the upper members. The shoulders of a garment, such as a shirt, coat or jacket, are draped over the upper members of the hanger to suspend the garment from the hanger in a generally upright orientation so as to reduce the risk of wrinkling or creasing garment. When the lower traverse member is present, additional garments, such as pants or trousers may be draped over and/or suspended from the lower transverse member to similarly reduce the risk of wrinkling or creasing of the garment.

Clothes closets in the typical home are often crowded with hanging items making it difficult to secure or remove an item to or from a hanger. Tight necked clothes such as shirts, sweaters and the like are difficult to put on conventional hangers which tend to stretch and/or deform the tight neck when placed thereon. Hangers in hotels and cloak rooms have a tendency to disappear and thus are increasingly manufactured with a closed hook so as to make them non-removable from the hanger bar and difficult to secure or remove items from the hanger. Suitcases come equipped with non-removable or difficult to remove hangers making it difficult to secure or remove items from hangers. There is a continuing need for a collapsible clothes hanger which allows easy and convenient securing, hanging and removal of clothes therefrom.

A variety of foldable clothes hangers have been proposed in the past which are foldable into a relatively compact unit for storage and transportation, and which may be deployed to form a conventional hanger when needed. U.S. Pat. No. 2,420,116 to Walters discloses a foldable clothes hanger using chain members which loosely fall on collapse and may become entangled with other items or objects.

U.S. Pat, No. 5,044,534 to Hwang discloses another prior art foldable clothes hanger. In order to collapse the hanger in Hwang, however, a connection on the lower branch must first be disengaged, in order to separate this component into two distinct pieces.

U.S. Pat. No. 5,007,562 to Brink et al. discloses a foldable clothes hanger wherein the receptacle bearing the hook protrudes downward and significantly extends into the hanger triangle.

As a result of these and other disadvantages associated with the prior art, a need exists for an improved collapsible garment hanger.

SUMMARY OF THE INVENTION

The present invention, provides an improved collapsible hanger designed to minimize disadvantages associated with the prior art. The hanger comprises first and second elongate upper members, each having a near and far end; a central support member; and, an elongate lower member comprising two pivotally connected elongate segments. The near ends of the first and second elongate upper members are pivotally connected to opposite ends of the central support member, and opposite ends of the elongate lower member are pivotally connected between the far ends of the first and second upper members. Hook means is provided on the central support member for securing the hanger to a hanging bar or the like.

The central support member provides the platform from which both the stable and collapsible utility of the hanger are derived. It can be of any convenient form, providing it has a sufficiently rigid mass to enable the pivotal connection of the near ends of the elongate upper members to it. In one embodiment the central support member is a generally vertically oriented elongate structure comprising a hook means at its top end with the near ends of the upper elongate members pivotally connected to it at a common point along about the centerline of its vertical length, spaced from the hook means. In a further embodiment, near ends of the upper elongate members are pivotally connected to the central support member at spaced points, preferably about equidistant spaced from the centerline of its vertical length. In a preferred embodiment, the central support member is a generally horizontally oriented elongate structure comprising a hook means extending upwardly from about the centerline of the horizontal width of the support member, with the near ends of the elongate upper members pivotally connecting to points spaced horizontally from about such centerline. In a particularly preferred embodiment, the central support member is a generally horizontally oriented elongate structure comprising hook means extending upwardly from about the centerline of its horizontal width, and the near ends of the elongate upper members pivotally connecting to it at points about equally horizontally spaced from about the centerline of the horizontal width of the support member.

The length of both upper members and the distance between pivot points in the upper members need not be the same. Similarly, the length of segments comprising the lower member and the distance between pivot points of segments need not be the same for the hanger to collapse in accord with the invention. However, in its preferred embodiment, the distance between the pivot points at the far and near end of the elongate upper members are dimensioned at or about the same distance; and, the distance between the pivot point of a segment of a lower member with the far end of an upper member to the pivot point of such segment with a pivotally connected second segment are dimensioned at or about the same distance.

Near ends of the first and second elongate upper members are pivotally connected to opposite ends of the central support member and the far ends of the upper members are pivotally connected to far ends of the segments which are pivotally connected at their near ends to form the lower member. The upper members, central support member and the pivotally connected segments of the lower member are dimensioned so that when the hanger is held by its hook in a normal coat hanging position, with the pivot point connecting segments of the lower member raised to a position above the pivot points of connection of the far ends of the segments with the far ends of the upper members, the hanger comprises a stable platform with the upper members extending at an angle to horizontal as a shoulder for hanging a jacket, coat, shirt or the like thereon.

In contrast, when the pivot point connecting two segments of the lower member is lowered to a position below the pivot points of connection of the far ends of segments to the far ends of the upper members, the hanger collapses under its own weight with the lower member and the upper members pivoting generally vertically downwardly from the central base support member, to release the jacket, coat, shirt or the like from support.

In one embodiment, the central support member comprises a stop wherein the pivotally connected near ends of the segments engage the support member and maintain a stable position by the downward force of the weight of the upper members. In further embodiment, the stop comprises the apex of an obtuse angled notch in the underside of the support member into which the pivotally connected ends of the segments insert. The near ends of the segments may engage the apex of the notch and/or edges or sides of the central support member forming the notch. In a still further embodiment, means are provided to restrain the pivot point of the segments from disengaging from a position above the pivot point of the segments with the upper members. In one embodiment latch means is provided to engage a segment and/or the pivot axis between segments to restrain the segments from disengagement from position. In still another embodiment magnetic means are provided to attract a metal strip or the like to restrain segments from disengaging from its position. It should be understood that many means for retaining things from falling are well known in the art and any suitable such means adaptable to retain the pivot point of the segments from disengaging from their position above the pivot points of segments with the upper members is contemplated as within the invention.

In a preferred embodiment, locking means are provided for locking the pivotable connection between segments of the lower member along about a common centerline. Such embodiment allows the lower member to function as a rigid member between the pivot connections with the upper members, thus providing a further utility of the lower member, as for example draping pants and the like thereover. In one embodiment the locking means comprises a hollow tube or the like which in whole or part surrounds a segment and is arranged as a sleeve or the like to be slidably moved to and from a position which interferes with the pivoting action of the near ends of connecting segments, to prevent collapsing the hanger. It should be understood that means for interfering with the pivoting action of pivotally connecting members are well known in the art and such means adaptable to the aforesaid pivoting connection is understood as contemplated within the invention.

Hook means for connecting the hanger along a hanger bar or the like are well known in the prior art. Such means can be any suitable means and can be formed from the structure of the central support member and/or connected thereto. Hook means can be rigidly or movable connected and can be closed loops which fasten the hanger to a hanger bar or comprise open hooks, with or without snag resistant ends such as beads or reverse bends or the like, all of which are well known in the fastening art. Any suitable such means adaptable to a variety of coat hanger bars and the like is understood as contemplated within the invention.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE INVENTION

Figure 1:
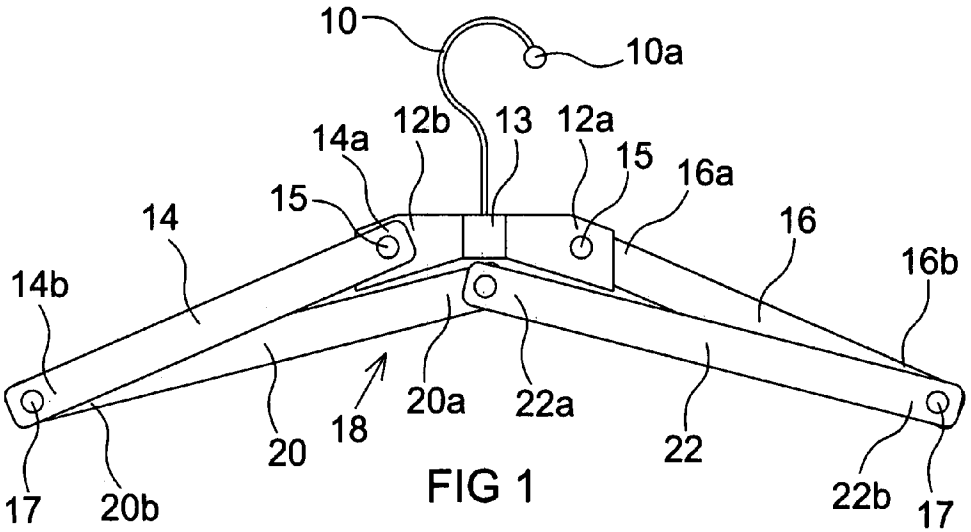
FIG. 1. is a front elevation view of a fully deployed collapsible hanger according to the present invention.
Figure 2:
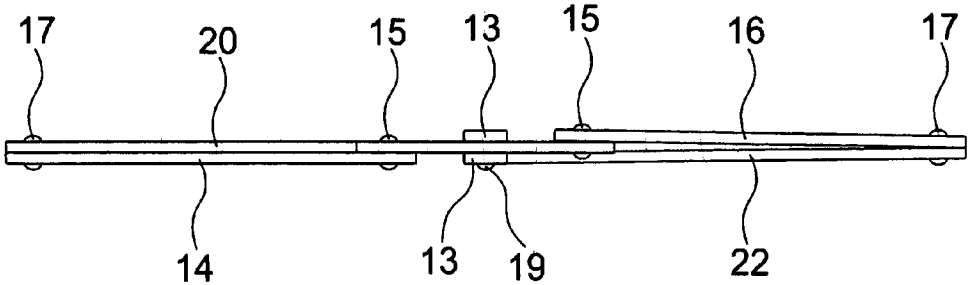
FIG. 2 is a top elevational view of the fully deployed collapsible hanger of FIG. 1.
Figure 3:
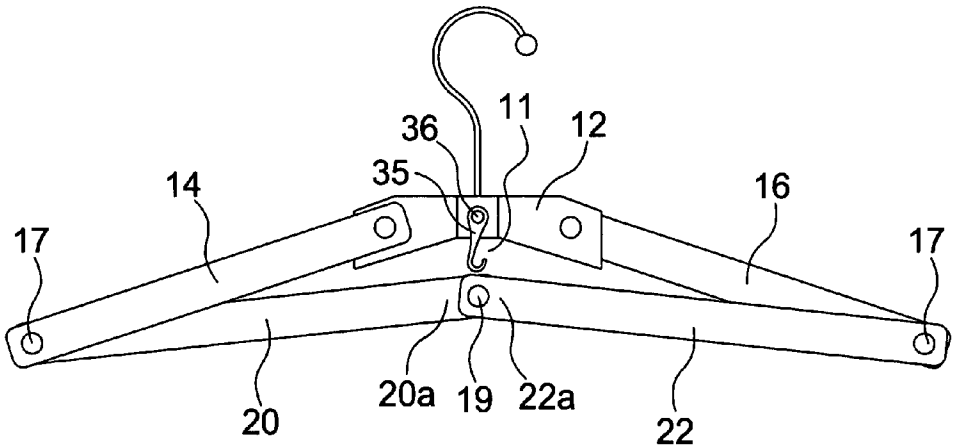
FIG. 3 is a front elevational view of another embodiment of a collapsible hanger of the invention illustrating a partially deployed state.
Figure 4:
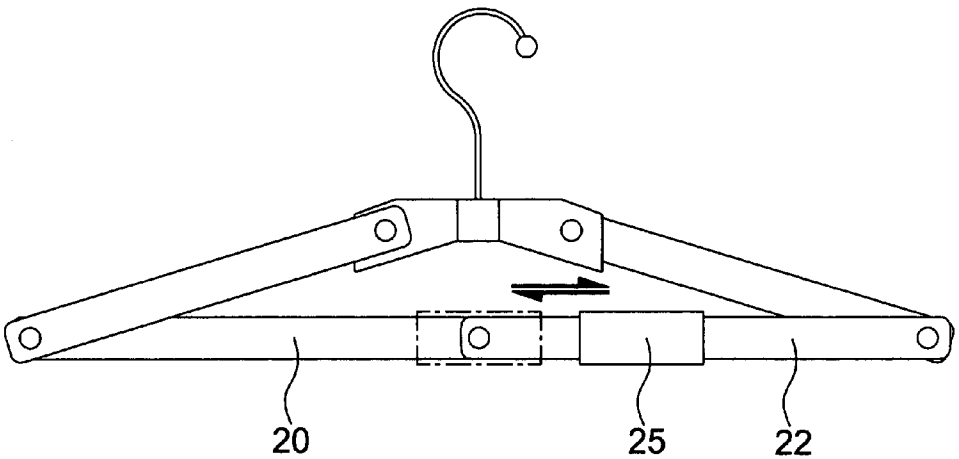
FIG. 4 is a front elevational view of a collapsible hanger of the invention, illustrating a pivot lock embodiment of full deployment.
Figure 5:
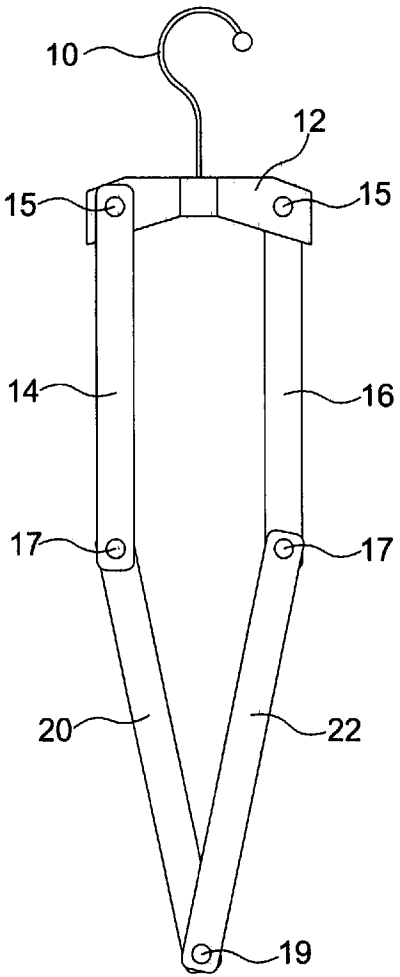
FIG. 5 is a front elevational view of a collapsed hanger of the invention.

FIGS. 1 and 2 illustrate a hanger of the invention in a fully deployed arrangement, with the suspension hook removed in FIG. 2 for clarity of illustration. FIG. 3 illustrates a hanger of the invention in a partially deployed state. FIG. 4 illustrates a further embodiment of the hanger in a further fully deployed state. FIG. 5 illustrates a hanger of the invention in a collapsed state.

Referring now to FIGS. 1–2, wherein a collapsible hanger, constructed according to the teachings of the present invention is generally illustrated in a first deployed state.

Therein, suspension hook 10 comprising anti-snag bead 10*a* is provided for suspending the hanger from a bar, rod, or other suitable hanger support means. The collapsible hanger is illustrated as having a generally triangular shape, formed from first and second elongate upper members 14 and 16 with their near ends 14*a* and 16*a* connecting to opposite ends 12*a* and 12*b* of central support member 12 and extending angularly downwardly in opposite directions to connect at their far ends 14*b* and 16*b* to traversing lower member 18. Lower member 18 is illustrated as comprising segments 20 and 22 with near ends 20*a* and 22*a* connecting, and far ends 20*b* and 22*b* connecting with far ends 14*b* and 16*b* of the upper members. Central support member 12 is illustrated as comprising a wire suspension hook 10 which is anchored or otherwise secured thereto, and as comprising notch 11 (see FIG. 3) and stops 13.

Rivet connectors 15 pivotally connect near ends 14*a* and 16*a* of upper members 14 and 16 to opposite ends 12*a* and 12*b* of central support member 12. Rivet connectors 17 pivotally connect far ends 14*b* and 16*b* of upper members 14 and 16 to far ends 20*b* and 22*b* of segments 20 and 22. Near ends 20*a* and 20*b* of segments 20 and 22 are pivotally connected by rivet connector 19.

FIG. 1 illustrates the position of the components of the hanger in a fully deployed state. In this state, segments 20 and 22 have pivoted upwardly around rivet connector 19 into notch 11 with their near ends 20*b* and 22*b* engaging stops 13. The deployed position is maintained by a combination of moments of force occasioned by gravity acting upon upper members 14 and 16. Thus, hook 10 supports central support member 12 and near ends 14*a* and 16*a* of the upper members. The near ends of the upper members are pivotally connected by rivets 15 to the central support member and gravitational force along the length of the upper members cause the far ends of the upper members to move downwardly in an arc toward a vertical position. When the pivot axis of rivet 19 is raised to a position higher than a straight line drawn between the pivot axis of rivets 17, the weight of the upper arms force ends 20*a* and 22*a* of the segments at the pivot axis of rivet 19 upwardly into notch 11 in stable deployment. Adding the weight of a jacket or the like to the hanger strengthens the stability of the deployed hanger.

FIG. 3 illustrates a partially deployed state of a hanger, wherein pivot axis of rivet 19 is above a straight line drawn between the pivot points of rivets 17 and upward movement of rivet 19 toward notch 11 is unassisted. FIG. 3 further illustrates a deployment lock 35, pivotally connected 36 to central support member 12 and arranged to engage rivet 19 to restrain ends 20*a* and 22*a* of the segments from unintentional release from notch 11. The deployment lock is particularly useful in circumstances wherein the hanger is being utilized in conditions wherein a sudden bouncing movement may cause release of ends 20*a* and 22*a* from notch 11, such as during vehicle and the like travel.

FIG. 4 illustrates another embodiment of a hanger of the invention comprising a pivot lock means full deployment. In this embodiment pivot lock 25 is arranged to enable locking segments 20 and 22 in a non-pivoting functional state. Therein, pivot lock 25 is illustrated as comprising a hollow tube which is lockingly engaged by slidably positioning it over the pivot axis of rivet 19 as desired. It should be apparent that when the pivot lock is engaged, segments 20 and 22 are prevented from pivoting in respect to each other and the lower member becomes a stable bar which may be used for draping items such as pants, skirts or the like thereover as are typical hangers. Thus, in a pivot locked full deployment of the invention, the hanger retains itself in a stable generally triangular form which cannot easily be collapsed and functions as a typical hanger. When the pivot lock is disengaged, the hanger functions as a convenient collapsible hanger with closely similar characteristics to one not containing a pivot lock.

FIG. 5 illustrates the collapsed state of a hanger of the invention. Collapsing a fully deployed hanger can occur by at least two processes. A first process is to manually manipulate the pivot point of rivet 19 to a position to about or below the straight line between the pivot points of rivets 17, whereupon the hanger collapses with upper members 14 and 16 moving toward a vertical position with ends 20*b* and 22*b* of segments 20 and 22 moving to their lowest point achievable. When collapsed, the upper arms are no longer in a supporting position for an item such as a jacket or the like hanging therefrom and such item is released for convenient retrieval. The process described above is simply reversed, in order to deploy the hanger for use from its fully collapsed state.

A convenient second process is a quick upward movement of the hanger to an abrupt stop or reverse in direction. In this action, when the upward movement is abruptly stopped and/or reversed, the upper arms tend to pivot upwardly at the pivot points of rivets 15 thus in the same movement raising the far ends of the upper arms comprising the pivot points of rivets 17 and pulling down the near ends of the segments to a point about at or below a straight line between the pivot points of rivets 17. As with the first process the hanger collapses and the item hanging therefrom is released for convenient retrieval. The process described can be simply reversed, or hand manipulated in order to deploy the hanger for use from its fully collapsed state.

The present invention, therefore, provides an improved collapsible hanger that provides the strong, rigid, construction of a conventional hanger when deployed, yet can be quickly and easily collapsed for convenient removal of hanging clothes.

While various embodiments of this invention have been shown and described, it would be apparent to those skilled in the art that many more modifications are possible without departing from the inventive concept herein. For example, the hanger may be deployed or collapsed using a different combination or series of steps than those described above. The pivot arrangements can be any pivoting arrangement, such as for example simple rivets connecting overlapping ends of a central support member, upper members and segments of the lower member, ball and socket pivot arrangements or slot and shoulder pivot arrangements or hinge arrangements. It is, therefore, to be understood that within the scope of the appended claims, this invention may be practiced otherwise than as specifically described.

What is claimed is:

1. A collapsible clothes hanger comprising:

a central support member;

a hook coupled to the central support member;

a pair of upper members having near and far ends, said near ends of said upper members pivotally connected to the central support member, said far ends of said upper members extending in opposite directions from said central support member;

a lower member extending between the far ends of said upper members, said lower member comprising a pair of elongate segments with each segment having a near end and a far end;

wherein said near ends of said segments are pivotally connected to each other, and said far ends of said segments comprise opposite ends of said lower member and are pivotally connected to opposite far ends of said pair of upper members.

2. The collapsible hanger of claim 1 wherein said upper members and said segments pivot along about parallel planes.

3. The collapsible hanger of claim 1 wherein pivoting movement at said near ends of said segments, displaces such near ends of said segments toward and away from said central support member.

4. The collapsible hanger of claim 1 comprising a locking member arranged to prevent pivoting movement at said near ends of said segments.

5. The collapsible hanger of claim 2 wherein said locking member comprises a sleeve slidably provided around said lower member.

6. The collapsible hanger of claim 1 wherein said near ends of said upper members are pivotally connected at spaced points on said central support member.

7. The collapsible hanger of claim 6 wherein said near ends of said upper members are pivotally connected at horizontally spaced points on said central support member.

8. The collapsible hanger of claim 1 wherein a member is connected to pivot in a single plane.

9. The collapsible hanger of claim 1 wherein two pivotally connected members pivot in about parallel planes.

10. The collapsible hanger of claim 9 wherein all pivotally connected members pivot in about parallel planes.

11. The collapsible hanger of claim 1 wherein the central support member comprises a surface arranged to accept near ends of pivotally connected segments.

12. The collapsible hanger of claim 11 comprising a stop for engaging said near ends of said pivotally connected segments.

13. The collapsible hanger of claim 11 wherein said surface comprises a notch arranged to accept near ends of pivotally connected segments.

14. The collapsible hanger of claim 11 comprising means for restraining the near ends of segments from disengaging from a position proximate said notch.

15. The collapsible hanger of claim 14 wherein said means for restraining is selected from latch means and magnetic means attraction means.

16. A collapsible garment hanger comprising:

a central support member;

a hook coupled to the central support member;

a pair of upper members having near and far ends, said near ends of said upper members pivotally connected to the central support member, said far ends of said upper members extending in opposite directions from said central support member;

a lower member extending between the far ends of said upper members, said lower member comprising a pair of elongate segments with each segment having a near end and a far end;

wherein said near ends of said segments are pivotally connected to each other, said far ends of said segments are pivotally connected to opposite far ends of said pair of upper members, said upper members and said segments pivot along about parallel planes, and pivoting movement at said near ends of said segments, displaces such near ends of said segments toward and away from said central support member.

17. The collapsible hanger of claim 16 wherein said near ends of said upper members are pivotally connected at spaced points on said central support member and at least two connected members pivot in about parallel planes.

18. The collapsible hanger of claim 16 comprising a locking member arranged to prevent pivoting movement at said near ends of said segments.

19. The collapsible hanger of claim 16 comprising means for restraining the near ends of segments from disengaging from a position proximate said central support member.

* * * * *